US011639572B2

(12) United States Patent
Bae et al.

(10) Patent No.: US 11,639,572 B2
(45) Date of Patent: May 2, 2023

(54) WASHING MACHINE AND METHOD FOR CONTROLLING THE SAME

(71) Applicant: LG Electronics Inc., Seoul (KR)

(72) Inventors: Suncheol Bae, Seoul (KR); Jain Koo, Seoul (KR); Baekeun Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 348 days.

(21) Appl. No.: 16/778,866

(22) Filed: Jan. 31, 2020

(65) Prior Publication Data

US 2020/0248359 A1 Aug. 6, 2020

(30) Foreign Application Priority Data

Feb. 1, 2019 (KR) ..... 10-2019-0014119

(51) Int. Cl.
*D06F 33/48* (2020.01)
*D06F 33/44* (2020.01)
(Continued)

(52) U.S. Cl.
CPC ..... *D06F 33/48* (2020.02); *D06F 33/44* (2020.02); *D06F 37/20* (2013.01); *D06F 37/04* (2013.01);
(Continued)

(58) Field of Classification Search
CPC ..... D06F 33/48; D06F 33/44; D06F 37/20; D06F 37/04; D06F 2103/24;
(Continued)

(56) References Cited

U.S. PATENT DOCUMENTS

2008/0066238 A1* 3/2008 Lee ..... D06F 34/16 68/12.02
2009/0300852 A1* 12/2009 Bae ..... D06F 33/48 68/12.04
(Continued)

FOREIGN PATENT DOCUMENTS

| | | |
|---|---|---|
| EP | 3276066 | 1/2018 |
| KR | 1994-0008628 | 9/1994 |
| WO | WO2018048235 | 3/2018 |

OTHER PUBLICATIONS

Extended European Search Report in European Application No. 20154841.9, dated Jun. 16, 2020, 11 pages.

*Primary Examiner* — Michael E Barr
*Assistant Examiner* — Pallavi Chitta
(74) *Attorney, Agent, or Firm* — Fish & Richardson P.C.

(57) ABSTRACT

A washing machine includes a water storage tank, a vibration sensor provided to the water storage tank, a washing tub rotatably disposed in the water storage tank and configured to accommodate laundry therein, a motor configured to rotate the washing tub, and a controller. The controller is configured to: measure an unbalance (UB) value based on rotating the washing tub during a dewatering stroke; control the motor to stop rotating the washing tub based on the UB value exceeding an allowable UB value included in a preset UB table; measure a dewatering time of the laundry and a vibration value during the dewatering stroke using the vibration sensor; and change the allowable UB value included in the preset UB table based on the dewatering time and the vibration value.

13 Claims, 8 Drawing Sheets

(51) Int. Cl.

| | |
|---|---|
| ***D06F 37/20*** | (2006.01) |
| *D06F 103/26* | (2020.01) |
| *D06F 103/24* | (2020.01) |
| *D06F 37/04* | (2006.01) |

(52) U.S. Cl.
CPC ..... *D06F 2103/24* (2020.02); *D06F 2103/26* (2020.02)

(58) Field of Classification Search
CPC ..... D06F 2103/26; D06F 33/76; D06F 34/16; D06F 2103/38; D06F 2105/52; D06F 37/304; G06N 3/08
See application file for complete search history.

(56) References Cited

U.S. PATENT DOCUMENTS

| | | | | |
|---|---|---|---|---|
| 2013/0247305 | A1* | 9/2013 | Janicek | D06F 35/007 8/137 |
| 2015/0252510 | A1 | 9/2015 | Heo et al. | |
| 2018/0291548 | A1* | 10/2018 | Cho | D06F 33/00 |

* cited by examiner (a) < WHEN EXCEEDING ALLOWABLE VIBRATION VALUE >

(b) < WHEN EXCEEDING ALLOWABLE TIME >

FIG. 8

| | | DEWATERING SECTIONS | | | | |
|---|---|---|---|---|---|---|
| LAUNDRY AMOUNT | LAUNDRY -TANGLED DEGREE | 1st SECTION | 2nd SECTION | 3rd SECTION | ··· | Nth SECTION |
| ⋮ | ⋮ | ⋮ | ⋮ | ⋮ | ··· | ⋮ |
| Lv. 3 | class 1 | a1 | b1 | c1 | ··· | d1 |
| | class 2 | a2 | b2 | c2 | ··· | d2 |
| | class 3 | a3 | b3 | c3 | ··· | d3 |
| ⋮ | ⋮ | ⋮ | ⋮ | ⋮ | ··· | ⋮ |

< UB TABLE >

FIG. 9

| | | DEWATERING TIME(s) | | | VIBRATION VALUE(mm) |
|---|---|---|---|---|---|
| LAUNDRY AMOUNT | LAUNDRY -TANGLED DEGREE | 1st TIME | 2nd TIME | 3rd TIME | |
| Lv. 3 | class 2 | 21 | 18 | 28 | 18 |

FIG. 10

< WHEN VIBRATION VALUE EXCEEDING ALLOWABLE VIBRATION VALUE>

| | | DEWATERING SECTIONS | | | | |
|---|---|---|---|---|---|---|
| LAUNDRY AMOUNT | LAUNDRY -TANGLED DEGREE | 1st SECTION | 2nd SECTION | 3rd SECTION | ... | Nth SECTION |
| Lv. 3 | class 2 | a2↓ | b2↓ | c2↓ | ··· | d2↓ |

< WHEN AVERAGE OF DEWATERING TIME EXCEEDING ALLOWABLE TIME >

| | | DEWATERING SECTIONS | | | | |
|---|---|---|---|---|---|---|
| LAUNDRY AMOUNT | LAUNDRY -TANGLED DEGREE | 1st SECTION | 2nd SECTION | 3rd SECTION | ... | Nth SECTION |
| Lv. 3 | class 2 | a2↑ | b2↑ | c2↑ | ··· | d2↑ |

WASHING MACHINE AND METHOD FOR CONTROLLING THE SAME

CROSS-REFERENCE TO RELATED APPLICATION

Pursuant to 35 U.S.C. § 119(a), this application claims the benefit of the earlier filing date and right of priority to Korean Application No. 10-2019-0014119, filed on Feb. 1, 2019, the contents of which are incorporated by reference herein in their entirety.

TECHNICAL FIELD

The present disclosure relates to a washing machine and a method for controlling the same, and more particularly, to a washing machine capable of performing artificial intelligence-based machine learning dewatering, and a method for controlling the same.

BACKGROUND

A washing machine is a device that can remove dirt from laundry (hereinafter also referred to as "fabric") such as clothing, bedding, etc. by using chemical cleaning action of water and detergent, and physical action such as friction between water and the laundry.

A washing machine may be classified into an agitator type, a pulsator type, and a drum type. The drum type washing machine may include a water storage tank (or tub) for storing water and a washing tub (or drum) rotatably disposed in the water storage tank to accommodate laundry therein.

The washing tub (or drum) is formed with a plurality of through holes through which water passes. A washing operation is generally divided into a washing stroke (cycle), a rinsing stroke (cycle) and a dewatering stroke (cycle). A process of each stroke may be displayed through a control panel (or display) provided outside a washing machine.

The washing stroke may include an operation to remove dirt from laundry using friction between water stored in the water storage tank and the laundry placed in the washing tub, and chemical cleaning action of detergent in water.

The rinsing stroke may include an operation to rinse the laundry with clean water to remove the detergent soaked (adhered) from it during the washing stroke by supplying clean water (no detergent dissolved) into the water storage tank. A fabric softening agent may be supplied together with the water during the rinsing stroke.

The dewatering stroke may include an operation to remove water from the laundry by rotating the washing tub at high speed after the rinsing stroke is finished. In some cases, an entire washing operation of the washing machine may be finished with an end of the dewatering stroke. In some cases, for example, in the case of a combo washer dryer, a drying stroke may be further added after the dewatering stroke.

In some examples, the washing operation may be set to operate under a different condition depending on a load or amount of laundry (hereinafter also referred to as "amount of fabrics") placed in the washing tub. For example, a water level, washing strength, a drain time, a dewatering time, etc., may vary according to the amount of laundry.

In some cases, washing performance can vary according to not only the amount of laundry but also a laundry type (fabric type). Therefore, when setting the washing operation only based on the amount of laundry, sufficient washing performance cannot be obtained.

In some cases, a washing machine may sense an amount of laundry and a fabric type. For example, the washing machine may detect the amount of laundry by using an average value of current values, and detect the fabric type by using a current value deviation.

In some cases, in the washing operation, laundry may need to be effectively or evenly loaded (distributed) in the dewatering stroke after the washing and rinsing strokes are finished. If the laundry is not evenly loaded and concentrated on one side, an unbalance (UB) of laundry may be generated, which may cause the washing tub to shake or vibrate a lot. In some cases, a dewatering stroke time may become longer and noise may become larger.

In some cases, the washing machine may include only a fixed UB table in which the allowable UB value, a criterion for initializing (interrupting) the dewatering process, is set according to the laundry amount. For example, a fixed allowable UB value may only take the laundry amount into account without considering the laundry-tangled degree.

In some cases, where a fixed allowable UB value is used, a dewatering time may become longer, or noise caused by abnormal vibration occurs in a high-speed dewatering section or period. This is because the laundry-tangled degree is not taken into consideration at all.

In some cases, even in the same washing machine product, there may be a need for a control method for proactively performing custom tuning for each installation place since an installation condition, a product condition, sensor distribution, etc. can vary according to each washing machine installation place.

Recently, there has been an increase interest in machine learning, artificial intelligence (AI), and deep learning.

For instance, the machine learning may focus on statistics-based classification, regression, and cluster models. In particular, in supervised learning of the classification and regression models, the learning models that distinguish new data from characteristics of learning data based on these characteristics may be defined by a person in advance. The deep learning, on the other hand, is one in which a computer searches for and identifies its own characteristics.

One of the factors that accelerated development of the deep learning may be deep learning frameworks provided as an open source such as Theano of the University of Montreal, Canada, Torch of New York University, Caffe of the University of California, Berkeley, and TensorFlow of Google.

With the release of deep learning frameworks, in addition to deep learning algorithms, extraction and selection of data used for a learning process, a learning method, and learning are becoming more important for effective learning and recognition.

In addition, research is being actively conducted for applying artificial intelligence and machine learning to various products and services.

Development in employing artificial intelligence and machine learning in a dewatering stoke may improve an optimization of the dewatering stroke.

SUMMARY

The present disclosure describes a washing machine capable of preventing delay in a dewatering time and reducing noise during a dewatering stroke, and a method for controlling the same.

The present disclosure also describes a washing machine capable of performing a dewatering stroke while satisfying both a dewatering time condition and a vibration condition based on data measured several times during the dewatering stroke, and a method for controlling the same.

The present disclosure further describes a washing machine capable of changing a UB table, which is a criterion for initializing a dewatering stroke, in order to perform the dewatering stroke while satisfying both a dewatering time condition and a vibration condition, and a method for controlling the same.

The tasks to be solved in the present disclosure may not be limited to the aforementioned, and other problems to be solved by the present disclosure will be obviously understood by a person skilled in the art based on the following description.

According to one aspect of the subject matter described in this application, a washing machine includes a water storage tank, a vibration sensor provided to the water storage tank, a washing tub rotatably disposed in the water storage tank and configured to accommodate laundry therein, a motor configured to rotate the washing tub, and a controller. The controller is configured to: measure an unbalance (UB) value based on rotating the washing tub during a dewatering stroke; control the motor to stop rotating the washing tub based on the UB value exceeding an allowable UB value included in a preset UB table; measure a dewatering time of the laundry and a vibration value during the dewatering stroke using the vibration sensor; and change the allowable UB value included in the preset UB table based on the dewatering time and the vibration value.

Implementations according to this aspect may include one or more of the following features. For example, the controller may be configured to: compare the changed allowable UB value to the UB value measured during the dewatering stroke; and determine whether to stop rotating the washing tub based on comparing the changed allowable UB value to the UB value measured during the dewatering stroke.

In some implementations, the controller may be configured to set a different allowable UB value based on a change of one or both of the dewatering time and the vibration value. In some examples, the controller may be configured to: increase the allowable UB value based on the dewatering time exceeding a threshold time; and decrease the allowable UB value based on the vibration value exceeding a reference vibration value. In some examples, the controller may be configured to increase the allowable UB value based on an average of multiple dewatering times exceeding the threshold time. In some examples, the controller may be configured to determine the average of the multiple dewatering times based on a predetermined number of latest dewatering times.

In some implementations, the controller may be configured to decrease the allowable UB value based on one or more events of the measured vibration value exceeding the reference vibration value. In some implementations, the controller may be configured to decrease the allowable UB value based on (i) the dewatering time exceeding the threshold time and (ii) the vibration value exceeding the reference vibration value. In some implementations, the controller may be configured to maintain the allowable UB value based on (i) the dewatering time being less than or equal to the threshold time and (ii) the vibration value being less than or equal to the reference vibration value.

In some implementations, the controller may be configured to: detect a laundry amount and a laundry-tangled degree of the laundry accommodated in the washing tub; identify an allowable UB value associated with the laundry amount and the laundry-tangled degree in the preset UB table; and change the allowable UB value associated with the laundry amount and the laundry-tangled degree in the preset UB table based on the dewatering time and the vibration value.

In some examples, the preset UB table may include a plurality of allowable UB values, each allowable UB value corresponding to one of a plurality of laundry-tangled degrees and one of a plurality of laundry amount levels. The controller may be configured to: determine whether the dewatering time exceeds a preset dewatering time limit based on decreasing the allowable UB value; based on the dewatering time exceeding the preset dewatering time, identify an allowable UB value in the preset UB table corresponding to a highest laundry-tangled degree among the plurality of laundry-tangled degrees; and perform the dewatering stroke by using the allowable UB value corresponding to the highest laundry-tangled degree.

In some implementations, the controller may be configured to output information indicating that the allowable UB value has been changed. In some implementations, the controller may be configured to output information indicating that the dewatering time or the vibration value has been reduced by the changed allowable UB value.

According to another aspect, a method for controlling a washing machine includes: detecting a laundry amount and a laundry-tangled degree of laundry accommodated in the washing machine; performing a dewatering stroke of the washing machine; measuring a dewatering time of the laundry and a vibration value generated during the dewatering stroke; and changing an allowable unbalance (UB) value included in a preset UB table based on the dewatering time and the vibration value.

Implementations according to this aspect may include one or more of the following features. For example, the method may further include: measuring a UB value during the dewatering stroke; comparing the UB value to the changed allowable UB value; and determining whether to stop rotating a washing tub of the washing machine based on comparing the UB value to the changed allowable UB value.

In some implementations, changing the allowable UB value may include setting a different allowable UB value based on a change of one or both of the dewatering time and the vibration value. In some implementations, changing the allowable UB value may include: increasing the allowable UB value based on the dewatering time exceeding a threshold time; and decreasing the allowable UB value based on the vibration value exceeding a reference vibration value.

In some implementations, changing the allowable UB value may include decreasing the allowable UB value based on (i) the dewatering time exceeding the threshold time and (ii) the vibration value exceeding the reference vibration value. In some examples, changing the allowable UB value may include maintaining the allowable UB value based on the dewatering time being less than or equal to the threshold time and the vibration value being less than or equal to the reference vibration value.

In some implementations, the preset UB table may include a plurality of allowable UB values, in which each allowable UB value corresponds to one of a plurality of laundry-tangled degrees and one of a plurality of laundry amount levels. The method may further include: determining whether the dewatering time exceeds a preset dewatering time limit based on decreasing the allowable UB value; based on the dewatering time exceeding the preset dewatering time, identifying an allowable UB value in the set UB table corresponding to a highest laundry-tangled degree among the plurality of laundry-tangled degrees; and performing the dewatering stroke by using the allowable UB value corresponding to the highest laundry-tangled degree.

In some implementations, the present disclosure can reduce noise generated by vibration during a high-speed dewatering process or reduce a dewatering time by changing a UB table, which is a criterion for initializing (interrupting) a dewatering process (stroke).

In some implementations, the present disclosure can provide an optimized dewatering control method for performing dewatering while satisfying both a vibration condition and a dewatering time condition by changing a UB table.

In some implementations, the present disclosure can provide an AI powered dewatering control method capable of changing a UB table so as to address a condition that dissatisfies the user more when both a vibration condition and a dewatering time condition are not satisfied.

The effects of the present disclosure are not limited to those effects mentioned above, and other effects not mentioned may be clearly understood by those skilled in the art from the description of the appended claims.

BRIEF DESCRIPTION OF THE DRAWINGS

FIGS. 4 to 10 are conceptual views illustrating the control method of FIG. 3.

DETAILED DESCRIPTION

Description will now be given in detail according to exemplary implementations disclosed herein, with reference to the accompanying drawings. For the sake of brief description with reference to the drawings, the same or equivalent components may be provided with the same or similar reference numbers, and description thereof will not be repeated.

Figure 1:
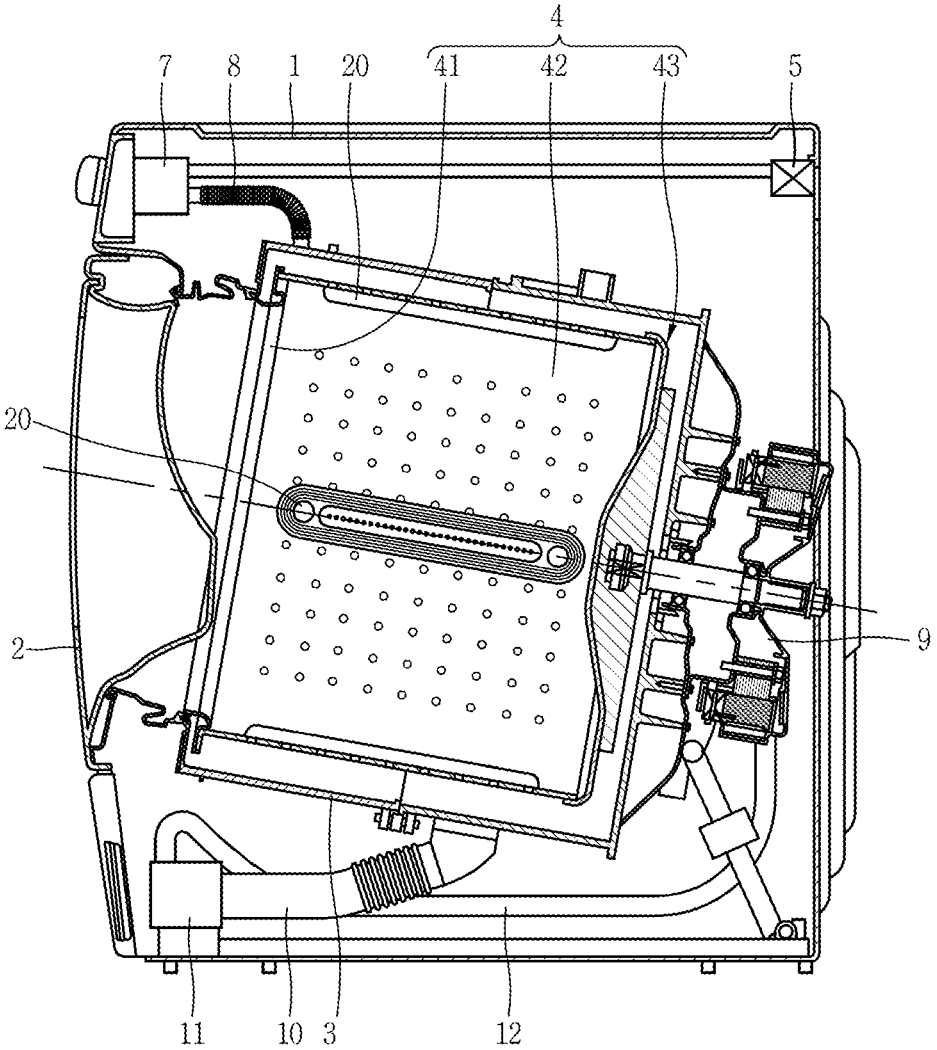
FIG. 1 is a lateral sectional view illustrating an example of a washing machine.
Figure 2:
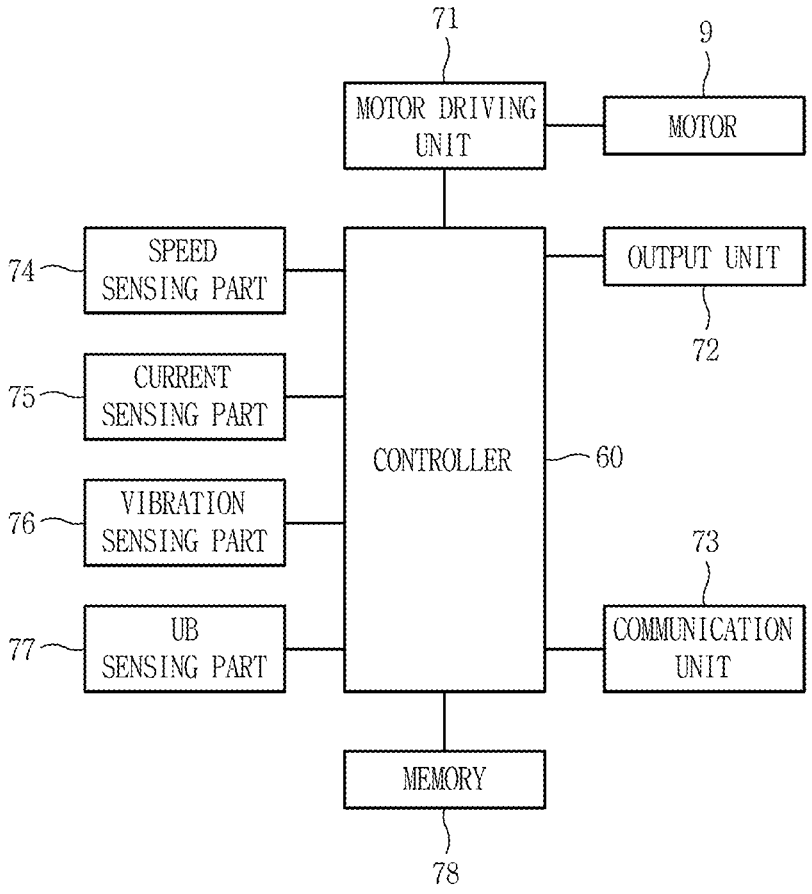
FIG. 2 is a block diagram illustrating an example of a control relationship between example components of the washing machine of FIG. 1.

FIG. 1 is a lateral sectional view illustrating an example of a washing machine, and FIG. 2 is a block diagram illustrating an example of a control relationship between main components of a washing machine of FIG. 1.

Referring to FIG. 1, a washing machine includes a casing 1 forming an outer appearance, a water storage tank (or tub) 3 disposed in the casing 1 and configured to store wash water therein, a washing tub 4 rotatably disposed in the water storage tank 3 into which laundry is introduced, and a motor 9 configured to rotate the washing tub 4.

In some implementations, the washing tub 4 may include a front cover 41 having an opening for putting in and taking out laundry, a cylindrical drum 42 substantially horizontally disposed so that a front end thereof is coupled to the front cover 41, and a rear cover 43 coupled to a rear end of the drum 42. A rotation shaft of the motor 9 may be connected to the rear cover 43 by passing through a rear wall of the water storage tank 3. A plurality of through holes may be formed in the drum 42 so that water is exchanged between the washing tub 4 and the water storage tank 3.

In some implementations, a lifter 20 may be provided on an inner circumferential surface of the drum 42. The lifter 20 protruding from the inner circumferential surface of the drum 42 extends long to a length direction (a forward-backward direction) of the drum 42, and a plurality of lifters 20 may be disposed in a circumferential direction with some spacing therebetween. Laundry may be lifted up by the lifter 20 when the washing tub 4 is rotated.

In some examples, although it is not limited to this, a height of the lifter 20 protruding from the drum 42 may be 30 mm or less (or 6.0% of a drum diameter), for example, from 10 to 20 mm. Particularly, when the height of the lifter 20 is 20 mm or less, even if the washing tub 4 is continuously rotated in one direction at approximately 80 rpm, laundry may be moved without being attached to the washing tub 4. That is, when the washing tub 4 rotates in one direction more than once, the laundry located at the lowermost position in the washing tub 4 may be lifted up to a predetermined height by the rotation of the washing tub 4 and then dropped while being separated from the washing tub 4.

The washing tub 4 rotates centered on a horizontal axis. Here, the term "horizontal" does not mean geometric horizontal in the strict sense, but it is close to horizontal rather than vertical even when it is inclined at a predetermined angle with respect to the horizontal axis as shown in FIG. 1. In some examples, the washing tub 4 may rotate with respect to the horizontal axis.

A laundry inlet is formed at a front surface of the casing 1 (cabinet), and a door 2 for opening and closing the laundry inlet is rotatably provided in the casing 1. A water inlet valve 5, a water inlet pipe 6, and a water inlet hose 8 may be installed in the casing 1. When the water inlet valve 5 is opened for supplying water, wash water having passed through the water inlet pipe 6 may be mixed with a detergent in a dispenser 7 and then introduced into the water storage tank 3 through the water inlet hose 8.

An input port of a pump 11 is connected to the water storage tank 3 through a drain hose 10, and an outlet port of the pump 11 is connected to the drain pipe 12. The water discharged from the water storage tank 3 through the drain hose 10 is fed by the pump 11 to flow along the drain pipe 12, and is then discharged to the outside of the washing machine.

Referring to FIG. 2, a washing machine may include a controller 60 configured to control the entire operation of the washing machine, a motor driving unit 71 controlled by the controller 60, an output unit 72, a communication unit 73, a speed sensing part 74, a current sensing part 75, a vibration sensing part 76, a UB sensing part 77, and a memory 78. The memory 78 may include non-transitory memory device.

The controller 60 may control a series of washing processes of washing, rinsing, dewatering, and drying. The controller 60 may perform washing, rinsing, dewatering, and drying according to a preset algorithm, and also control the motor driving unit 71 according to the algorithm. For example, the controller 60 may include a processor, an electric circuit, etc. In some cases, the controller 60 may include or communicate with one or more of the output unit 72, the communication unit 73, the speed sensing part 74, the current sensing part 75, the vibration sensing part 76, the UB sensing part 77, and the memory 78.

The motor driving unit 71 may control driving of the motor 9 in response to a control signal applied by the controller 60. The control signal may be a signal for controlling a target speed of the motor 9, an acceleration tilt (or acceleration), a driving time, and the like.

The motor driving unit 71 is for powering the motor 9, which may include an inverter and an inverter controller. In addition, the motor driving unit 71 may further include a converter or the like used for supplying direct current (DC) power to the inverter.

For example, when the inverter controller outputs a switching control signal of a Pulse Width Modulation (PWM) method to the inverter, then the inverter performs high switching so as to supply alternating current (AC) power of a predetermined frequency to the motor 9.

In some implementations, controlling the motor 9 may be performed in a specific manner by the controller 60. For example, the controller 60 may apply a control signal to the motor driving unit 71 so that the motor driving unit 71 controls the motor 9 in the specific manner based on the control signal. Here, the specific manner may include various implementations described herein.

The speed sensing part 74 detects a rotational speed of the washing tub 4. The speed sensing part 74 may detect rotational speed of a rotor of the motor 9. When a planetary gear train that rotates the washing tub 4 by changing a revolution ratio of the motor 9 is provided, the rotational speed of the washing tub 4 may be a value converted to the rotational speed of the rotor sensed by the speed sensing part 74 in consideration of a deceleration or acceleration ratio of the planetary gear train.

The controller 60 may control the motor driving unit 71 so that the motor 9 follows a preset target speed by giving feedback on the rotational speed of the washing tub received from the speed sensing part 74. In other words, the controller 60 may control the motor 9 so that the rotational speed of the washing tub reaches the target speed.

The current sensing part 75 detects an electric current applied to the motor 9 (or output current flowing to the motor 9) to transmit the sensed current to the controller 60. The controller 60 may detect the laundry amount and laundry-tangled degree using the received current.

At this time, values of the current include values obtained in a process in which the washing tub 4 is accelerated toward the target speed (or a process in which the motor 9 is accelerated toward the preset target speed).

When rotation of the motor 9 is controlled by vector control based on a torque current and a magnetic flux current, the current may be a torque axis (q-axis) component flowing to a motor circuit, namely, a torque current (Iq).

The vibration sensing part 76 detects vibration in the water storage tank 3 (or washing machine) generated by rotation of the washing tub 4 in which laundry is accommodated.

A washing machine may include a vibration sensor (or a vibration measurement sensor). The vibration sensor may be provided at one point in the washing machine, e.g., at one point of the water storage tank 3. Alternatively, the vibration sensor may be provided in the vibration sensing part 76.

The vibration sensing part 76 may receive a vibration value (or vibration signal) measured by the vibration sensor to transmit the vibration value to the controller 60. The vibration sensing part 76 may also calculate a vibration value (or intensity of vibration) of the water storage tank 3 (or washing machine) using the vibration signal measured by the vibration sensor.

In some examples, the present disclosure may further include a UB sensing part 77. The UB sensing part 77 may detect an amount of eccentricity (an amount of shaking) of the washing tub 4, that is, unbalance (UB) of the washing tub 4. The UB sensing part 77 may calculate a UB value that numerically indicates shaking of the washing tub 4.

The UB sensing part 77 will be described later in more detail.

The speed sensing part 74, current sensing part 75, vibration sensing part 76, and UB sensing part 77 provided in the washing machine may also be referred to as a sensing unit or a sensor, and be understood as a concept included in the sensing unit or the sensor.

In some implementations, the sensing unit may measure (calculate) a plurality of types of data including at least one of the rotational speed value (or speed value) of the washing tub 4 measured by the speed sensing part 74, the current value applied to the motor 9, which is measured by the current sensing part 75, the vibration value of the water storage tank 3 measured by the vibration sensing part 76, and the shaking value (UB value) of the washing tub 4 measured by the UB sensing part 77.

The plurality of types of data may include data related to unbalance (UB) of the washing tub 4, data for measuring UB of the washing tub 4, data obtained by rotation of the washing tub 4, and the like. The plurality of types of data may be used to control the washing tub 4 during the dewatering stroke.

For example, the plurality of types of data may be input as an input value of an artificial neural network (ANN) learned through machine learning to calculate the laundry-tangled degree as an output value.

In some examples, in the drawing, the speed sensing part 74, the current sensing part 75, the vibration sensing part 76, and the UB sensing part 77 are separately provided from the controller 60, but the present disclosure is not limited thereto.

At least one of the speed sensing part 74, the current sensing part 75, the vibration sensing part 76, and the UB sensing part 77 may be provided in the controller 60. In this case, functions/operation/control methods performed by the speed sensing part 74, the current sensing part 75, the vibration sensing part 76, and the UB sensing part 77 may be performed by the controller 60.

It will be understood that when the vibration sensing part 76 is included in the controller 60 or is performed by the controller 60, the vibration sensor is separately provided at one point of the washing machine, not included in the vibration sensing part 76.

The controller 60 may include a learning module for laundry amount/laundry-tangled degree, and a recognition module for a laundry amount/laundry-tangled degree. The learning module for the laundry amount/laundry-tangled degree uses at least one of the plurality of types of data detected by the speed sensing part 74, the current sensing part 75, the vibration sensing part 76, and the UB sensing part 77 for machine learning. Through this machine learning, the learning module for laundry amount/laundry-tangled degree may update a pre-learned artificial neural network stored in the memory 78.

A learning method of the learning module for laundry amount/laundry-tangled degree may include at least one of unsupervised learning and supervised learning.

The recognition module for laundry amount/laundry-tangled degree may determine a level of the laundry amount and a level of the laundry-tangled degree based on data (or ANN) learned by the learning module for laundry amount/laundry-tangled degree.

Determining the laundry amount may be a task of classifying the laundry placed in the washing tub 4 into a plurality of preset levels according to weight (load).

Determining the laundry-tangled degree may be a task of classifying the laundry placed in the washing tub 4 into a plurality of preset levels (or steps, classes) according to a degree of tangling.

The recognition module for laundry amount/laundry-tangled degree may determine a level of laundry amount and a step of laundry-tangled degree (that is, a laundry-tangled degree according to a laundry amount) for the laundry placed in the washing tub 4 based on the plurality of types of data obtained from at least one of the speed sensing part 74, the current sensing part 75, the vibration sensing part 76, and the UB sensing part 77.

The above-described learning module for laundry amount/laundry-tangled degree and recognition module for laundry amount/laundry-tangled degree may be independent components, and be included in the controller 60.

Also, functions/operation/control methods performed by the learning module for laundry amount/laundry-tangled degree and recognition module for laundry amount/laundry-tangled degree may be performed by the controller 60. Hereinafter, for convenience of explanation, description will be given under assumption that the controller 60 performs the functions/operation/control methods of the learning module for laundry amount/laundry-tangled degree and recognition module for laundry amount/laundry-tangled degree.

The output unit 72 may output various information related to a washing machine. For example, the output unit 72 outputs an operating state of the washing machine. The output unit 72 may be an image output device for outputting a visual display such as a liquid crystal display (LCD) or a light emitting diode device (LED), or an acoustic output device for outputting sound such as a buzzer or a speaker. The output unit 72, controlled by the controller 60, may output information of the laundry amount or the laundry-tangled degree.

A programmed ANN, a current pattern according to the laundry amount and/or the laundry-tangled degree, a database (DB) constructed by machine learning based on the current pattern, a machine learning algorithm, current values detected by the current sensing part 75, average values of the detected current values, values obtained by processing the average values according to a parsing rule, and data transmitted and received through the communication unit 73, and the like may be saved in the memory 78.

In addition, data such as all sorts of control data for controlling the entire operation of the washing machine, data of washing settings input by the user, data of wash time calculated according to the washing settings, data of wash courses, data for determining a washing machine error, and the like may be saved in the memory 78.

The communication unit 73 may communicate with a server connected to a network. The communication unit 73 may include at least one communication module such as an Internet module, a mobile communication module, etc. The communication unit 73 may receive various types of data such as learning data and algorithm updates from the server.

The controller 60 may update the memory 78 by processing various types of data received from the communication unit 73. For example, in case data input through the communication unit 73 is related to an operation program update, which is prestored in the memory 78, the controller 60 may update the memory 78 using the update data. When the input data is about a new operation program, the controller 60 may additionally save the new operation program in the memory 78.

Machine learning means that a computer learns from data and solves a problem without being explicitly instructed logic by a person.

Deep learning is an artificial intelligence technology, which is based on an ANN for constructing artificial intelligence so that a computer thinks and learns like people without having to teach it. The ANN may be implemented in a software form or in a hardware form such as a chip.

For example, a washing machine, based on the machine learning, may figure out properties of the laundry (fabric) (hereinafter, referred to as properties of fabric) introduced into the washing tub 4 by processing current values sensed by the current sensing part 75.

These properties of fabric may include the laundry amount, laundry-tangled degree, and fabric type.

The controller 60 may determine the laundry-tangled degree according to the laundry amount based on machine learning. For example, the controller 60 may measure the laundry amount to determine one category among the pre-classified categories based on the laundry-tangled degree. The laundry-tangled degree represents a degree to which the laundry (fabric) items placed in the washing tub 4 are tangled (or twisted) with each other and an extent to which one laundry (fabric) item is evenly loaded, or tangled, which may be classified into the preset laundry-tangled levels (steps).

For example, the lower the degree of tangled laundry, the less the laundry is tangled (that is, laundry is slightly tangled), and the higher the degree of tangled laundry, the more the laundry is tangled (that is, laundry is severely tangled).

Such a laundry-tangled degree may be variously defined or classified according to various types of laundry (fabric texture) in the washing tub 4, and may vary depending on a combination and properties of various types of the laundry. In case, the laundry type is the same, the laundry-tangled degree may be determined or varied depending on its material, moisture content, volume difference, and laundry type.

This laundry-tangled degree may be understood as a different concept from the fabric type defined based on various factors such as a fabric material, a degree of softness (e.g., soft/hard fabric), ability of the fabric to contain water (moisture content), a volume difference between dry fabric and wet fabric.

The controller 60 may detect the laundry amount by using a current value, which is currently detected by the current sensing part 75, as input data of the ANN pre-learned by machine learning until the target speed is reached.

In addition, the controller 60 may determine (predict, estimate, calculate) various information related to unbalance of the washing tub 4 using the ANN learned through machine learning.

For example, the controller 60 may sort (determine) the laundry-tangled degree by inputting the plurality of types of data as an input value of the ANN.

Hereinafter, the UB sensing part 77 for measuring unbalance of the washing tub 4 will be described in more detail.

The UB sensing part 77 may measure unbalance of the washing tub 4 generated when the washing tub 4 in which laundry is accommodated rotates. Here, unbalance of the washing tub 4 may include shaking of the washing tub 4 or a shaking value (or a degree of shaking) of the washing tub 4.

The UB sensing part 77 may measure (calculate) the shaking value (or degree of shaking) of the washing tub 4 (or drum). Here, the shaking value of the washing tub 4 may be named as a UB value, a UB amount, an unbalance value, an unbalance amount, or an eccentricity amount.

In some implementations, unbalance (UB) may include the amount of eccentricity of the washing tub 4, that is, unbalance of the washing tub 4 or shaking of the washing tub 4, which may be caused by uneven arrangement of the laundry.

The UB value is for indicating an intensity (or a degree) of shaking of the washing tub, which may be calculated (computed) based on the amount of rotational speed variations of the washing tub 4 (or motor 9), or the amount of acceleration variations of the washing tub 4 (or motor 9).

For example, the UB sensing part 77 may calculate the UB value by receiving the rotational speed of the washing tub 4 (or motor 9) measured by the speed sensing part 74 and using the amount of variations in the received rotational speed. Here, the amount of rotational speed variations may include, for example, a difference in rotational speed measured at predetermined time intervals, a difference in rotational speed measured at each time when the washing tub 4 is rotated by a predetermined angle, or a difference between the maximum rotational speed and the minimum rotational speed.

For example, the UB sensing part 77 may measure the rotational speed of the washing tub 4, measured by the speed sensing part 74, at each predetermined angle to calculate the UB value through a difference in the measured rotational speed. Thereafter, the UB sensing part 77 may calculate the UB value by using a value obtained by subtracting the minimum rotational speed from the maximum rotational speed in the measured rotational speed values.

As another example, the UB sensing part 77 may calculate the UB value (UB (k)) based on the formula 1 to 3 below by using rotational speed (e.g., rotational speed (RPM) at every 30 degrees) values measured at predetermined angles.

$$a_k=(v_k+v_{k-1}+\ldots+v_{k-5})-(v_{k-6}+v_{k-7}+\ldots+v_{k-11}) \quad \text{Formula 1}$$

$$v_k=v_{k+12} \quad \text{Formula 2}$$

$$UB(k)=\max(a_k,a_{k-1},\ldots,a_{k-11})-\min(a_k,a_{k-1},\ldots,a_{k-11}) \quad \text{Formula 3}$$

where $v_k$ to $v_{k-11}$ denotes rotational speed measured at each predetermined angle (30 degrees), and k is an integer.

Accordingly, the UB value becomes larger as shaking (or vibration) of the washing tub 4 during the rotation of the washing tub is increased due to uneven arrangement (unbalance) of the laundry in the washing tub 4.

As another example, the UB value may include a predetermined value proportional to the amount of rotational speed variations (a value obtained by subtracting the minimum rotational speed from the maximum rotational speed).

The UB value may be calculated based on the rotational speed of the washing tub, the current value applied to the motor, or the vibration value of the water storage tank 3 measured by the vibration sensor.

In some implementations, the UB value may be defined as various values measured by unbalance of the washing tub 4. For example, the UB value may be defined based on rotational speed (RPM) fluctuations of the washing tub 4 detected when the washing tub 4 rotates.

For example, in case laundry is placed to be concentrated in one side of the washing tub 4 or laundry is severely tangled, unbalance is increased (that is, unbalance becomes severe), causing the washing tub to shake or vibrate a lot while rotating. And the UB value becomes larger accordingly.

As the washing tub shaking becomes severe (as the UB value of the washing tub becomes larger), a large current load is applied to the motor 9 for rotating the washing tub 4 at high-speed during the dewatering stroke, causing huge energy consumption and noise.

When laundry is evenly distributed in the washing tub 4 or laundry is slightly tangled, the unbalance may be reduced. Accordingly, even if the washing tub is rotated at high speed, shaking of the washing tub becomes small, and the UB value becomes smaller accordingly.

In a washing machine, a laundry balancing process (laundry diffusion process) may be performed during the dewatering stroke by decreasing the UB value so as to reduce energy consumption and noise.

The laundry balancing process refers to a process for evenly loading the laundry in the washing tub 4 or for untangling the laundry. Unbalance of the washing tub 4 is reduced when the laundry is evenly loaded (distributed) or the tangled laundry gets untangled.

The laundry balancing process may include a process in which laundry is lifted up by a predetermined height and then dropped in order to evenly load or distribute the laundry. For this reason, the laundry balancing process may be performed during a dewatering section or period (for example, 80 RPM or lower section) in which the laundry is rotated without being attached to the washing tub 4 so as to be lifted up to the predetermined height then fall. As the laundry is lifted up to the predetermined height and then dropped, the tangled laundry gets untangled by impact of the drop. Accordingly, unbalance is reduced as the laundry becomes evenly loaded.

In some examples, rotation of the washing tub 4 may be stopped during the dewatering process (dewatering stroke) when a measured (detected) unbalance (UB) value, generated by the rotation of the washing tub, exceeds the preset allowable UB value (that is, when the UB value exceeds the preset allowable UB value).

Exceeding the preset allowable UB value means that shaking of the washing tub 4 is generated more than a reference vibration value as laundry in the washing tub 4 is unevenly distributed. In this case, when rotating the washing tub 4 at a high RPM, noise is generated and a large current load is consumed.

The controller 60 may interrupt (initialize) the dewatering process when the UB value exceeds the preset allowable UB value. For example, the controller 60 may stop rotating the washing tub for a period of time based on the UB value exceeding the allowable UB value, and restart rotating the washing tub based on an elapse of the period of time.

In some examples, interrupting the dewatering process may include an operation where the dewatering process is initialized so that the dewatering process is restarted from the beginning (or the dewatering process is started again from a section after detecting a dewatered laundry amount), the rotation of the washing tub 4 is stopped, interrupted, or a combination thereof.

The dewatered laundry amount detecting may be performed after the rinsing process is finished, in the final rinsing process, before the dewatering process, or at the beginning of the dewatering process. Detecting the dewatered laundry amount may include, for example, measuring (detecting) the amount of laundry containing water in a state rinsing and draining are completed.

The preset allowable UB value may include a preset reference value, which is a criterion for stopping rotation of the washing tub (initializing the dewatering process) during the dewatering process.

The preset allowable UB value may also be referred to as an allowable UB value limit, a reference UB value, a set UB value, a threshold UB value, or the like.

The allowable UB value may be set for each dewatering section (period) according to the laundry amount/laundry-tangled degree in the preset UB table.

In some examples, in the dewatering stroke, when a UB value, measured by rotation of the washing tub, exceeds a preset allowable UB value, initialization (dewatering process is being stopped for a restart) may be performed to evenly load the laundry so as to reduce the UB value. The initialization may include re-running the dewatering process in order to restart the dewatering stroke from the beginning (or from a step (section) after detecting a dewatered laundry amount).

Referring to FIG. 8, the UB table may have the allowable UB value set for each dewatering section (first to $n^{th}$ sections) according to the laundry amount and laundry-tangled degree. For example, when the laundry amount is a third level (level 3) and the laundry-tangled degree is a second step (class 2), the allowable UB value set for a first section (for example, a section at which rotational speed of the washing tub 4 is 108 RPM) may be a2.

The dewatering section (first to $n^{th}$ sections) is a plurality of sections included in the dewatering process. It may include at least one section among a rotational speed increase section, a rotational speed maintaining section, and a rotational speed reduction section, for example, a section in which rotation of the washing tub 4 is maintained at first speed, a section in which rotation of the washing tub 4 is accelerated to second speed from the first speed, a section in which rotation of the washing tub 4 is maintained at the second speed, a section in which rotation of the washing tub 4 is decelerated to third speed from the second speed, a section in which rotation of the washing tub 4 is maintained at the third speed.

In some implementations, the dewatering sections may include sections in which the rotational speed of the washing tub gradually increases by repeating maintenance sections and acceleration sections.

In some examples, the present disclosure can provide a washing machine capable of evolving to perform self-tuning fitting to each situation since an installation condition, a product condition, sensor distribution, etc. vary according to an installation place, and a method for controlling the same.

Specifically, the present disclosure can provide a washing machine capable of evolving by itself so as to address an issue regarding dewatering time and vibration noise that may be problematic during a dewatering process, and a method for controlling the same.

To this end, the present disclosure can provide a washing machine capable of changing an allowable UB value of each dewatering section according to a laundry amount/laundry-tangled degree included in a UB table so as to satisfy both a dewatering time condition and a vibration condition, and a method for controlling the same.

Hereinafter, the method for changing the allowable UB value included in the UB table will be described in more detail with reference to the accompanying drawings.

Figure 3:
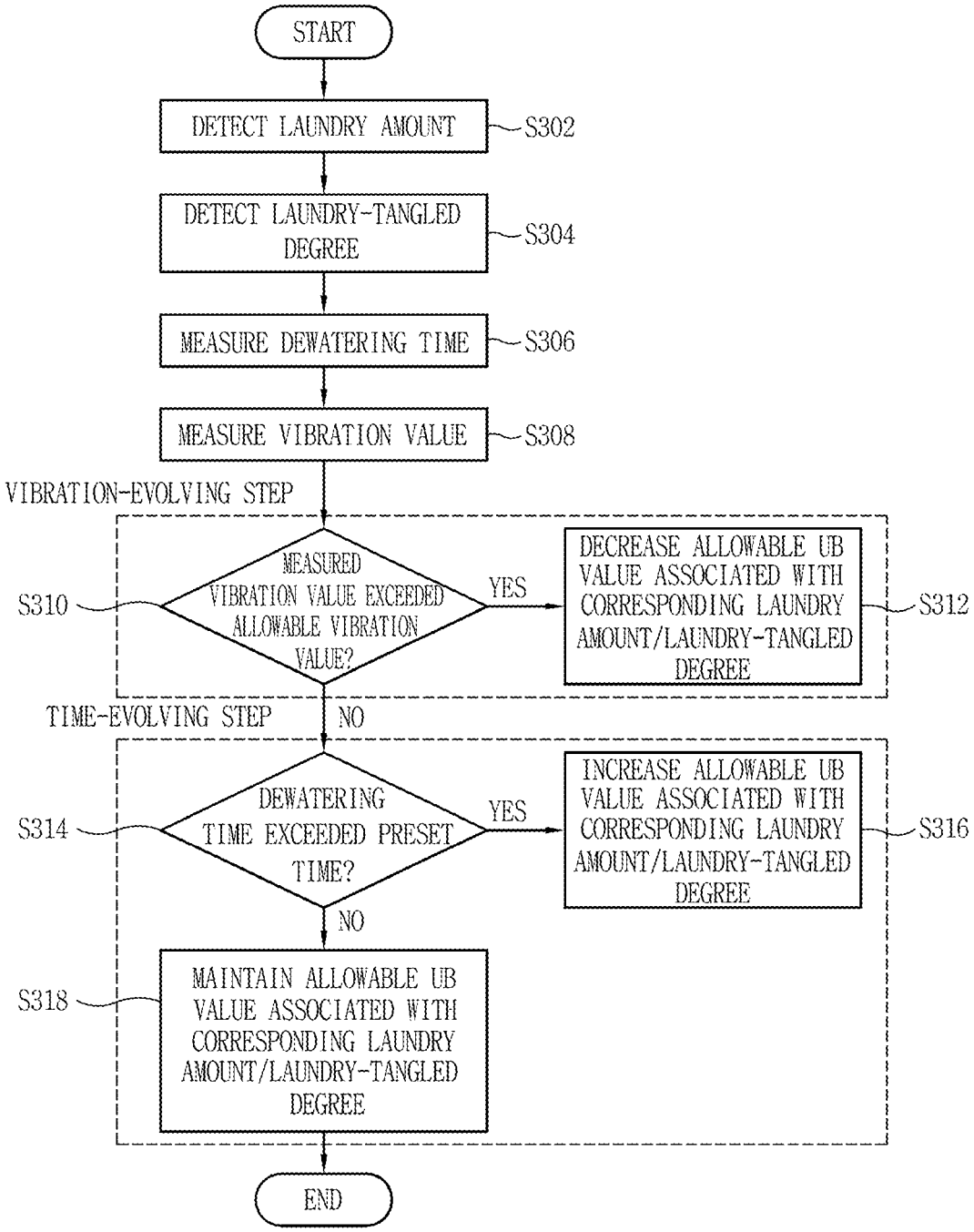
FIG. 3 is a flowchart illustrating an example control method.

FIG. 3 is a flowchart illustrating an example control method, and FIGS. 4-10 are conceptual views illustrating the control method of FIG. 3.

A washing machine may include a water storage tank 3, a vibration sensor provided in the water storage tank, a washing tub 4 configured to accommodate laundry therein and rotatably disposed in the water storage tank 3, a motor 9 configured to rotate the washing tub, and a controller 60 configured to control the motor 9 so as to stop rotation of the washing tub 4 when a measured (detected) unbalance (UB) value, generated by the rotation of the washing tub 4 in a dewatering process (stroke), exceeds an allowable UB value included in a preset UB table.

In a washing machine, preset types of data may be measured during a dewatering process for changing a UB table to satisfy both a dewatering time condition and a vibration condition during the dewatering process. Here, the preset types of data may be a dewatering time and a vibration value.

Thereafter, the washing machine may classify and store the preset types of data according to a laundry amount and laundry-tangled degree.

Specifically, the controller 60 may sense the laundry amount and laundry-tangled degree each time when the dewatering process is performed, and record the preset types of data (a dewatering time and a vibration value) measured during the dewatering process according to the laundry amount and laundry-tangled degree. The recording process of the preset types of data according to the detected laundry amount and laundry-tangled degree may be performed by the controller whenever a plurality of dewatering sections is performed.

In other words, the controller 60 may save a history (record) of the preset types of data measured in the dewatering process sorted by the laundry amount and laundry-tangled degree.

When the preset types of data are stored (accumulated) according to the laundry amount and laundry-tangled degree, the controller 60 may change the allowable UB value of the preset UB table, which is a criterion for stopping rotation of the washing tub 4 during the dewatering process (or restarting the dewatering process from the beginning (or after section detecting a dewatered laundry amount) by using the stored preset types of data.

The allowable UB value of the preset UB table is a reference value of a criterion for stopping the rotation of the washing tub during the dewatering process (or a criterion for initializing (interrupting) so as to re-run the dewatering process from the beginning (or from a section after detecting the dewatered laundry amount).

For example, when the UB value generated by rotation of the washing tub exceeds the allowable UB value included in the preset UB table during the dewatering process, the controller 60 may control the motor to stop the rotation of the washing tub.

In other words, stopping the rotation of the washing tub may include initializing (interrupting) the dewatering process so as to restart the dewatering process from the beginning (or from a section after detecting the laundry amount), and interrupting rotation of the washing tub 4.

The controller 60 may change (modify) the allowable UB value included in the preset UB table, which is a criterion for stopping the rotation of the washing tub 4. At this time, the controller 60 may change (modify) the allowable UB value of the preset UB table so that a dewatering time condition and a vibration condition required for the dewatering process are satisfied, which may be used as an expression of evolving.

The controller 60 may collect various types of data during the dewatering process in order to determine whether to change the allowable UB value of the preset UB table.

To this end, the controller 60 detect the laundry amount and the laundry-tangled degree (S302, S304).

The controller 60 may sense the laundry amount at least one point of time before starting the washing stroke, after finishing the washing stroke, before starting the rinsing stroke, and after finishing the rinsing stroke. For example, the controller 60 may sense the dewatered laundry amount, which may include the amount of laundry in a wet state after the rinsing stroke is finished and water is completely drained out.

For example, the controller 60 may detect the laundry amount by using a current value (currently detected value of an electric current) sensed by the current sensing part 75 as input data of an ANN pre-learned by machine learning until rotational speed of the washing tub reaches a target speed. Here, the pre-learned ANN is a first ANN, which may be an ANN learned to detect the laundry amount.

In some examples, the controller 60 may detect not only the laundry amount but also the laundry-tangled degree.

The controller 60 may determine the laundry-tangled degree using a plurality of types of data measured in the rinsing stoke (rinsing process) before the dewatering stroke.

For example, the controller 60 may measure the plurality of types of data while rotating the washing tub at specific rotational speed before entering the dewatering process.

Here, before entering the dewatering process may include the rinsing process (or rinsing stroke).

In addition, the specific rotational speed is rotational speed at which a tumbling motion is performed. For example, the specific rotational speed may be somewhere between 40 and 50 RPM.

The tumbling motion allows the motor 9 to rotate the washing tub 4 in one direction so that laundry placed in an inner surface of the drum 42 is controlled to drop to the lowest point of the drum 42 at a position of about 90 to 110 degrees in a rotational direction of the washing tub 4. In the tumbling motion, the motor 9 rotates the washing tub 4 in one direction, and when the laundry rotates clockwise, the laundry moves from the third quadrant of the drum to a part of the second quadrant of the drum, and drops to the lowest point, and is then lifted up again to fall. Such series are repeated.

The controller 60 may measure the plurality types of data while rotating the washing tub at the specific rotational speed (for example, 46 RPM) so that laundry is lifted up by a predetermined height and then dropped during the rinsing process performed before the dewatering process.

In other words, the controller 60 may measure the plurality of types of data while rotating the washing tub 4 at the specific rotational speed so as to perform the tumbling motion during the rinsing process.

The plurality of types of data may include at least one of current rotational speed (Current RPM), speed UB (or UB value or virtual vibration amount), a q-axis current (Iq), starting/holding currents, information of laundry-amount level, and a vibration value.

The plurality of types of data may be data related to the rotation of the washing tub. For example, the plurality of types of data may be measured (calculated) by at least one of the speed sensing part 74, current sensing part 75, vibration sensing part 76, and UB sensing part 77.

The plurality of types of data may include a current RPM value (or current speed value) of the washing tub 4 measured by the speed sensing part 74, a current value applied to the motor 9 (q-axis current and starting/holding currents) measured by the current sensing part 75, a vibration value of the water storage tank 3 measured by the vibration sensing part 76, and a shaking value (UB value, speed UB) of the washing tub 4 measured by the UB sensing part 77.

Figure 4:
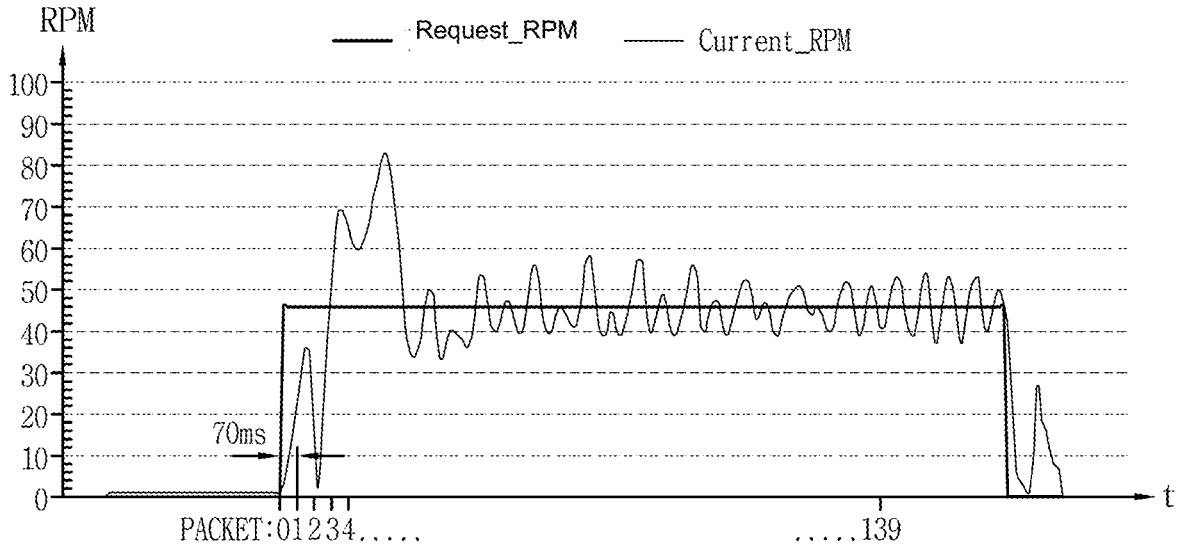

The current RPM, as illustrated in FIG. 4, may include the actually measured rotational speed (Current_RPM) of the washing tub 4, not the target rotational speed (Request_RPM).

Figure 5:
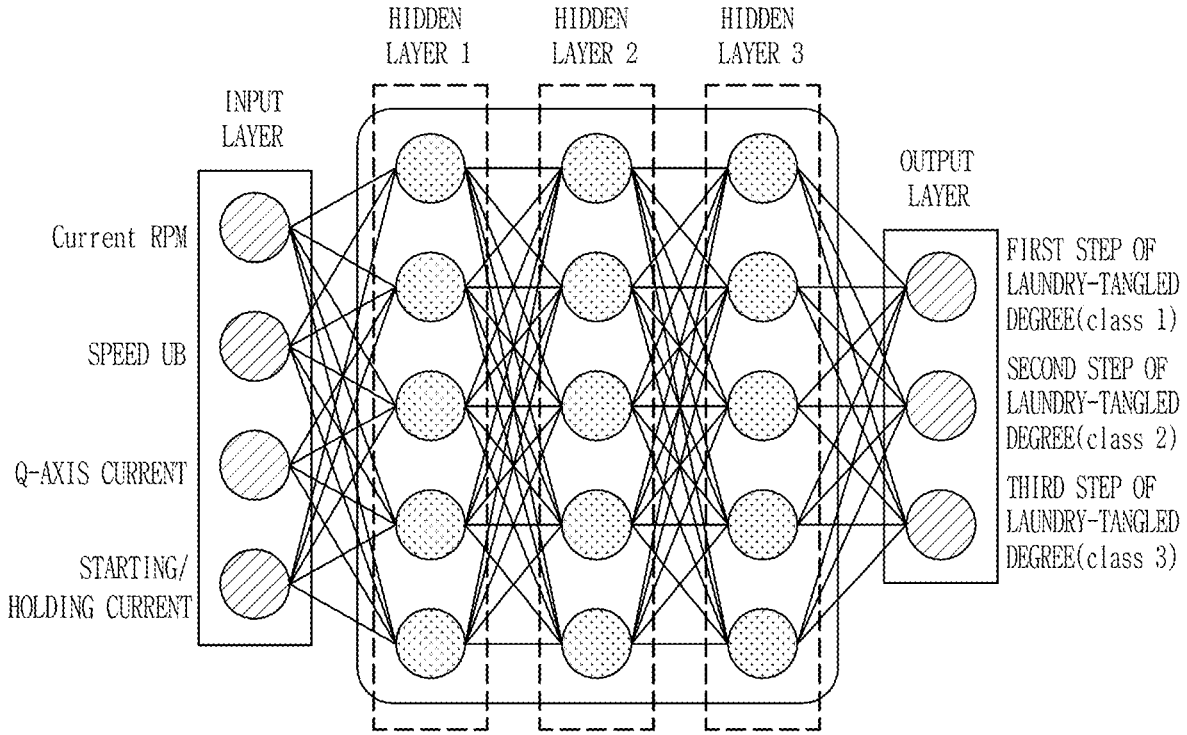

As illustrated in FIG. 5, although a control signal is applied to the motor driving unit 71 so as to rotate the washing tub 4 at the target rotational speed, unbalance is generated when the laundry is unevenly placed (distributed) in the washing tub 4, causing RPM fluctuations of the washing tub 4.

The current rotational speed (current RPM) may be data obtained by sequentially summing a predetermined number (for example, 10) of rotational speed values measured at predetermined time intervals (for example, 70 ms). However, the present disclosure is not limited to this, and the current RPM may also be an average value of the rotational speed values measured at predetermined time intervals (that is, an average value of data sequentially summed by the predetermined number of rotational speed values).

The speed UB (UB value) may be data obtained by sequentially summing a predetermined number (for example, 5) of speed UB values measured at predetermined time intervals (for example, 70 ms). Similarly, the speed UB may be an average value of UB values (or sum data) measured at predetermined time intervals.

The current RPM and the speed UB may be measured by the speed sensing part 74.

The q-axis current (Iq) represents a torque current (Iq) value (or the sum data of current values measured at each predetermined time intervals or the average value) corresponding to a torque axis (q-axis) component among the currents applied to the motor.

The starting current may include a current applied to accelerate the washing tub 4 to rotate a specific rotational speed (for example, 46 RPM), and the holding current may include a current applied to maintain a specific rotational speed after the washing tub 4 reaching it.

The starting/holding currents are generated after a predetermined time period has passed since the start, and may be one representative value. The starting/holding currents may be measured (calculated) based on the measured q-axis current.

The q-axis current and the starting/holding currents may be measured by the current sensing part 75.

In addition, when a vibration sensor is provided in a washing machine, the controller 60 may measure a vibration value of the water storage tank 3. Likewise, the vibration value may include a vibration displacement value of the water storage tank, and may include the sum data (or the average value) of the vibration values measured at predetermined time intervals.

In other words, the controller 60 may not only measure data at a specific moment but also use the sum data (or the average value) measured at predetermined time periods as data.

Further, the controller 60 may measure a plurality of different types of data, not just use one type of data.

The controller 60 may determine the laundry amount and laundry-tangled degree using the plurality of types of data measured.

For detecting the laundry amount, the controller 60 may input at least one of the plurality types of data (for example, a q-axis current) into the pre-learned ANN through machine learning to output (detect) the laundry amount as an output value.

In addition, the controller 60 may determine one level among the plurality of laundry-amount levels using the current value sensed by the current sensing part.

A washing machine may detect the laundry amount by applying at least one of the technologies for detecting all types of laundry amounts developed to date. The technology for detecting the laundry amount is a general technology, thus more detailed description thereof will be omitted.

The controller 60 may detect the laundry amount at various points of time. For example, the controller 60 may detect the laundry amount when measurement of the plurality of types of data is completed, or may detect the laundry amount before starting measurement of the plurality of types of data.

Also, the controller 60 may detect the laundry amount before entering the dewatering stroke (process), which is after completely draining water during the rinsing stroke.

In addition, the controller 60 may sense the laundry amount together when detecting (calculating) the laundry-tangled degree.

A point of time for detecting the laundry amount may be set differently and be determined or changed according to user settings.

The controller 60 may input the measured plurality of types of data as an input value of a pre-learned ANN to output the laundry-tangled degree as a result value. Here, the pre-learned ANN means an ANN which is learned for calculating the laundry-tangled degree, and may be named as a second ANN.

Specifically, the controller 60 may determine any one laundry-tangled degree among the plurality of classified steps (for example, a first step (level) (class 1), a second step (level) (class 2), and a third step (level) (class 3).

Referring to FIG. 5, the controller 60 may determine (detect, judge, and calculate) the laundry-tangled degree by using the plurality of types of data (for example, current RPM, speed UB, q-axis current, starting/holding currents) measured in the rinsing stroke as input data (input data, input layer) of the ANN pre-learned by machine learning.

The controller 60 may input the measured plurality of types of data as an input value of the pre-learned ANN to output the laundry-tangled degree as a result value. The laundry-tangled degree may be a degree of the tangled laundry.

At this time, the controller 60 may determine any one laundry-tangled degree among the plurality of classified laundry-tangled steps (a first step (class 1), a second step (class 2), a third step (class 3) through the pre-learned ANN.

In some examples, the present disclosure may include an ANN for calculating the laundry-tangled degree as a result value. Information of the ANN may be prestored in the memory 78 or the controller 60. FIG. 5 is a schematic view illustrating one example of the ANN.

Deep learning, a class of machine learning, may include learning deep down to multi-levels based on data.

Deep learning may represent a set (collection) of machine learning algorithms that extract key data from multiple data by going through hidden layers in order.

A deep learning structure may include an ANN. For example, the deep learning structure may include a Deep Neural Network (DNN) such as a Convolutional Neural Network (CNN), a Recurrent Neural Network (RNN), and a Deep Belief Network (DBN).

Referring to FIG. 5, the ANN may include an input layer, hidden layers, and an output layer. Having multiple hidden layers is referred to as a DNN. Each layer has a plurality of nodes, and each layer is connected to the next layer. Nodes may be interconnected with weights.

An output from any node belonged to a first hidden layer (Hidden Layer 1) may be input to at least one node belonged to a second hidden layer (Hidden Layer 2). In this case, an input of each node may be a value obtained by applying a weight to a node of the previous layer. The weight may include link strength between nodes. The deep learning process may be seen as a process of finding a proper weight.

The ANN employed in the washing machine may include the DNN that is learned through supervised learning using the plurality of types of data (current RPM, speed UB, q-axis current, and starting/holding currents) as input data and the laundry-tangled degree measured by experiments as result data.

The supervised learning may refer to one method of machine learning for deriving a function from training data.

The ANN may be a DNN that hidden layers are learned by experimentally measuring the laundry-tangled degree for each of a plurality of types of data, and inputting each of the plurality of types of data as input data and the laundry-tangled degree measured for each of the plurality of types of data as a result value. Here, learning the hidden layers may include adjusting (updating) the weights of inter-node connection lines included in the hidden layers.

Using this ANN, the controller 60 may calculate a plurality of types of data at a specific point of time (time point), set the plurality of types of data as an input value of the ANN to determine (predict, extract, calculate, judge, estimate) the laundry-tangled degree.

The controller 60 may perform learning by using the plurality of types of data corresponding to the current RPM, speed UB, q-axis current, and starting/holding currents as training data.

Also, the present disclosure is not limited to this, the controller 60 may use a vibration value and laundry amount as additional training data, and use the vibration value and laundry amount as an input value.

In addition, the controller 60 may update a DNN structure such as weight, bias, and the like whenever detecting or determining the laundry-tangled degree by adding the determined results and plurality of types of data input at that time to a database. Also, the controller 60 may update the DNN structure such as weight and the like by performing a supervised learning process using training data after a predetermined number of training data is obtained.

The controller 60 may input the plurality of types of data as an input value of the pre-learned ANN to output (determine, detect) the laundry-tangled degree as an output value.

Thereafter, the controller 60 may perform the dewatering process after the laundry amount and laundry-tangled degree are detected. The controller 60 may measure a dewatering time (S306).

The dewatering time may be at least one of a time point from the start of the dewatering process to the end of the dewatering process, a time required for the washing tub 4 to reach the maximum RPM after the dewatering process is started, and an entry time required to enter a main dewatering process of the dewatering process that includes pre-dewatering and main dewatering.

Here, the pre-dewatering process (pre-dewatering section) may include a section (for example, 80 to 90 RPM or lower) in which the laundry is untangled (or laundry is evenly loaded) by being lifted up to a predetermined height of the washing tub 4 and then dropped. The pre-dewatering process may refer to a low RPM section described in this specification.

The main dewatering process (main dewatering section) is a section in which the laundry is attached to the washing tub 4 to remove water while being rotated. For example, the washing tub 4 is rotated at a speed higher than the speed at which the laundry is attached (or in an attached state) to the washing tub 4 (e.g., 90 RPM or higher) during the main dewatering process.

For example, the main dewatering process may refer to the main dewatering section (or high-speed RPM section) described in this specification, and may include a section in which the washing tub rotates at speed higher than 108 RPM, for example.

In addition, the dewatering time may be one of a part of consecutive time in the dewatering process or a partially divided time in the dewatering process.

The dewatering process may be classified into a plurality of dewatering sections or periods. For example, the plurality of dewatering sections, as described above, may be divided into first to $n^{th}$ sections. For example, the dewatering time may be a time required for entering any section of the first to $n^{th}$ sections from the start of the dewatering process. Generally, as the degree of tangled laundry placed in the washing tub 4 is higher (laundry having high degree of tangling), the UB value is likely to increase, and a possibility of stopping (initializing (interrupting) the dewatering process) rotation of the washing tub is increased accordingly, thereby, extending the dewatering time.

In some examples, as the degree of tangled laundry placed in the washing tub 4 is lower (laundry having low degree of tangling), the UB value is likely to decrease, and the possibility of stopping (initializing (interrupting) the dewatering process) the rotation of the washing tub is decreased accordingly, thereby, reducing the dewatering time.

In addition, the controller 60 may measure the vibration value with a vibration sensor (S308).

Here, the vibration sensor may be provided at an outer surface of the water storage tank 3. The controller 60 may measure the vibration value (value of vibration displacement) of the water storage tank 3 with the vibration sensor.

Thereafter, in the present disclosure, the measured dewatering time and vibration value may be recorded (stored) according to the detected laundry amount and laundry-tangled degree, respectively. For example, as shown in FIG. 9, the dewatering time and vibration value, measured when the sensed laundry amount is level 3, and the sensed laundry-tangled degree is class 2, may be recorded separately according to the detected laundry amount and the laundry-tangled degree.

Like this, a table in which the dewatering time and vibration value are recorded based on the laundry amount and laundry-tangled degree may be named as a dewatering time/vibration value table according to the laundry amount/laundry-tangled degree.

In this manner, a laundry amount and laundry-tangled degree may be detected when a new washing operation is performed in a state information of the dewatering time and vibration value measured according to the sensed laundry amount and laundry-tangled degree is stored (recorded).

Thereafter, when the pre-measured dewatering time and vibration value corresponding to the laundry amount detected in a new washing operation exist, the controller 60 may use the pre-measured dewatering time and vibration value to determine whether to change the preset allowable UB value in the preset UB table.

The controller 60 may measure a dewatering time and a vibration value generated in the dewatering process using the vibration sensor, and change the allowable UB value included in the preset UB table based on the dewatering time and vibration value.

The controller 60 may change (modify) the allowable UB value in the preset UB table based on the dewatering time and vibration value, and determine whether to stop rotation of the washing tub 4 (whether to initialize (interrupt) the dewatering process) by comparing the changed (modified) allowable UB value with the UB value measured during the dewatering process.

Specifically, in a new washing operation, the controller 60 may detect a laundry amount and laundry-tangled degree to change the associated (related) allowable UB value, in the preset UB table, with the detected laundry amount and laundry-tangled degree based on the measured dewatering time and vibration value.

In some implementations, a dewatering time and vibration value are measured and recorded in a state the detected laundry amount is a third level (level 3) and laundry-tangled degree is a second step (class 2). This is equally applied to a new washing operation, so description will be given under assumption that an allowable UB value of a preset UB table is changed in a state the measured laundry amount is the third level (level 3) and degree of tangled laundry is the second step (class 2).

The controller 60 may change the allowable UB value in a different way according to the measured dewatering time and vibration value. Specifically, the controller 60 may increase or decrease the allowable UB value according to the measured dewatering time and vibration value.

For example, the controller 60 may determine whether the measured (pre-measured) vibration value with respect to the detected laundry amount and laundry-tangled degree exceeds an allowable vibration value (a preset reference value) (S310).

At this time, when the vibration value exceeds the allowable vibration value, the controller 60 may reduce the allowable UB value associated with the corresponding laundry amount and laundry-tangled degree in the preset UB table (S312).

In addition, when the vibration value is equal to or lower than the allowable vibration value, the controller 60 may determine whether the measured (pre-measured) dewatering time exceeds a preset time (threshold time) (S314).

Here, when the dewatering time exceeds the threshold time, the controller 60 may increase the allowable UB value (S316).

When the dewatering time is lower than or equal to the threshold time, and the vibration value is equal to or lower than the allowable vibration value, the controller 60 may maintain the allowable UB value (that is, may not change the allowable UB value).

Here, increasing, decreasing or maintaining the allowable UB value may include increasing, decreasing, or maintaining the allowable UB value, associated with the laundry amount and laundry-tangled degree measured during the washing operation in the preset UB table.

The threshold time may be set by the user, and may be, for example, a reference time used in a washing machine authorization test standard.

The allowable vibration value may be set by the user, for example, it may be determined based on spacing between the water storage tank 3 and the casing 1, or apply an allowable vibration value used in a washing machine qualification test standard.

Figure 6:
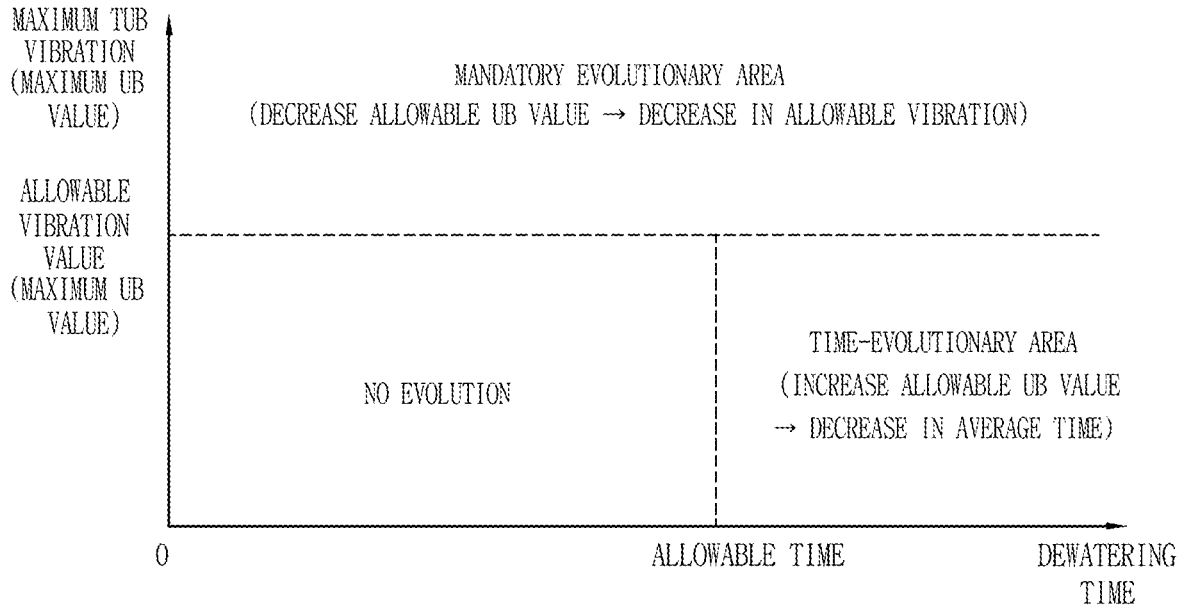
Figure 7:
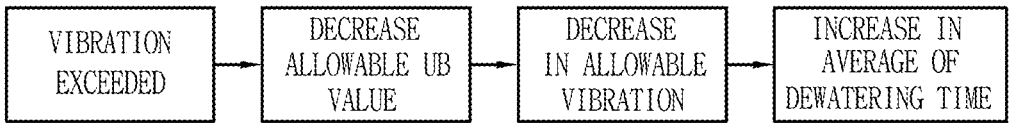
Figure 7:
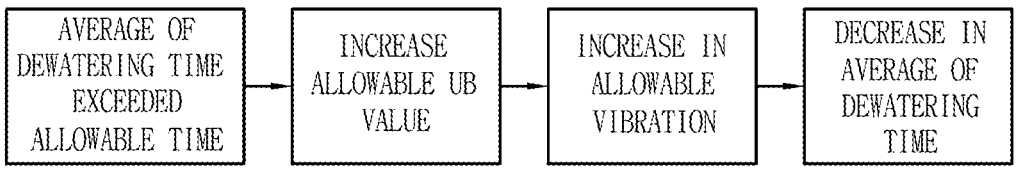

Referring to FIG. 6 and (a) of FIG. 7, when a vibration value measured in the detected laundry amount and laundry-tangled degree exceeds the allowable vibration value, the controller 60 may decrease the allowable UB value related to the detected laundry amount and laundry-tangled degree. That is, when the measured vibration value exceeds the allowable vibration value, the controller 60 regards it as a necessary evolutionary area that must be evolved, so the allowable UB value associated with the detected laundry amount and laundry-tangled degree may be reduced.

When decreasing the allowable UB value, the number of cases for a UB value measured in the dewatering process exceeding the decreased allowable UB value may be increased. In this case, the number of cases for stopping rotation of the washing tub 4 is increased. Then a laundry balancing or untangling process is performed by re-running the dewatering stroke (process) from the beginning (or from a section after detecting the laundry amount). When the laundry balancing process is performed, tangled laundry becomes untangled and unbalance (UB) is reduced, thereby lowering the UB value (or vibration value). Here, the measured vibration value may be a maximum vibration value measured during the entire dewatering process. In addition, the measured vibration value may include the maximum vibration value of the pre-dewatering and main dewatering process respectively, in case the dewatering process is divided into the pre-dewatering and main dewatering.

In other words, decreasing the allowable UB value may include reducing vibration allowed in the dewatering process.

When decreasing the allowable UB value, an allowable vibration range may be reduced, but the average dewatering time may be increased as the number of cases for stopping the rotation of the washing tub (initializing (interrupting) the dewatering process) are increased.

Referring to FIG. 6 and (b) of FIG. 7, when a dewatering time measured in a detected laundry amount and laundry-tangled degree exceeds the threshold time, the allowable UB value associated with the laundry amount and laundry-tangled degree may be increased. That is, when the measured dewatering time exceeds the threshold time, the controller 60 may regard it as a necessary time-evolutional area, and increase the allowable UB value associated with the detected laundry amount and laundry-tangled degree.

When increasing the allowable UB value, cases for an UB value measured during the dewatering process exceeding the increased allowable UB value may be reduced. Then the number of cases for stopping the rotation of the washing tub 4 is reduced.

In other words, increasing the allowable UB value may include increasing vibration allowed in the dewatering process.

When increasing the allowable UB value, noise is generated as the allowable vibration range is increased, but the number of cases for stopping the rotation of the washing tub (initializing (interrupting) the dewatering process) is reduced, thereby, decreasing the average dewatering time.

In a washing machine, when a vibration value measured in the detected laundry amount and laundry-tangled degree exceeds the allowable vibration value (or if there is a record (history) of a pre-measured vibration value exceeding the allowable vibration value), the preset UB table may be changed in order to prevent the vibration value from exceeding the allowable vibration value in the main dewatering process by decreasing the allowable UB value associated with the corresponding laundry amount and laundry-tangled degree.

In addition, in the washing machine, when a dewatering time measured in the detected laundry amount and laundry-tangled degree exceeds the threshold time (or if there is a record of a pre-measured dewatering time exceeding the threshold time), the preset UB table may be changed in order to prevent the dewatering time from exceeding the threshold time in the main dewatering process by increasing the allowable UB values associated with the corresponding laundry amount and laundry-tangled degree.

Like this, in the washing machine, the preset UB table may be changed so that the allowable UB value may satisfy both a dewatering time condition (equal to or lower than the threshold time) and a vibration condition (equal to or lower than the allowable vibration) for the detected laundry amount and laundry-tangled degree in a manner of decreasing the allowable UB value to reduce a vibration value when the vibration value is large while increasing the allowable UB value to reduce a dewatering time when the dewatering time is long.

The dewatering time condition means a condition in which the dewatering time is equal to or lower than the threshold time, and the vibration condition means a condition in which the vibration value (the maximum vibration value) is equal to or lower than the allowable vibration value.

In some examples, in the present disclosure, it is possible to determine whether to change the allowable UB value (preset UB table) by setting a priority, that is, which condition is put before either the vibration condition or the dewatering time condition.

Which condition, either the vibration condition or the dewatering time condition has a higher priority may be determined by user settings, for example, based on safety, a prior issue of user's complaints, user's preference, etc.

For instance, in case reducing noise (or safety) is set to have a higher priority, the allowable UB value may be changed according to the vibration condition. An example of changing the allowable UB value by putting the vibration condition before the time condition is as follows.

The controller 60 may decrease the allowable UB value when the measured dewatering time exceeds the threshold time and the vibration value exceeds the allowable vibration value. That is, when the vibration value exceeds the vibration allowable value and the dewatering time exceeds the threshold time at the same time, the controller 60 may decrease the allowable UB value in response to the vibration value exceeding the allowable vibration value.

In addition, as illustrated in FIG. 9, as for the vibration value, the controller 60 may change the allowable UB value based on one vibration value, measured the most recently. That is, the controller 60 may reduce the allowable UB value when the measured vibration value exceeds the allowable vibration value even once.

In some examples, as illustrated in FIG. 9, the controller 60 may increase the allowable UB value when the average of dewatering time, measured multiple times, exceeds the threshold time.

Here, the dewatering time measured multiple times may be a predetermined number (for example, 3) of dewatering time measured recently. The controller 60 may increase the allowable UB value by comparing the average of dewatering time measured multiple times (the predetermined number of) previously with the threshold time when the average of dewatering time exceeds the threshold time.

Since the vibration is directly related to safety, a washing machine can provide a washing machine control method for preventing vibration related accidents by putting the vibration condition before the dewatering time condition to change the allowable UB value.

In addition, the present disclosure is not limited to this, a washing machine control method capable of evolving to reduce noise can be provided to users who are more dissatisfied with noise than a prolonged dewatering time.

When the dewatering time condition is put before the vibration condition, control may be performed differently from the aforementioned description. An example of setting dewatering time condition having a higher priority is as follows.

The controller 60 may increase the allowable UB value when the measured dewatering time exceeds the threshold time even once and may decrease the allowable UB value when the average of vibration values, measured multiple times, exceeds the allowable vibration value.

In addition, the controller 60 may increase the allowable UB value to reduce a dewatering time when the dewatering time exceeds the threshold time and the vibration value exceeds the allowable vibration value at the same time.

In some examples, even when the dewatering time condition is set to have a higher priority, the controller 60 may increase the allowable UB value without exceeding the maximum allowable UB value. That is, the controller 60 may increase the allowable UB value within a range of the maximum allowable UB value even when the dewatering time exceeds the threshold time.

Here, the maximum allowable UB value may be an upper limit at which an allowable UB value associated with each laundry amount and laundry-tangled degree is changeable (modified) to the maximum, and may be a set value for preventing a safety-related accident even when vibration corresponding to the maximum allowable UB value occurs.

In some examples, even if the dewatering time condition has a higher priority, the controller 60 can prevent a safety-related accident caused by vibration by increasing the allowable UB value within the range of the maximum UB allowable value.

In some examples, a user may set and change a priority on a condition, either the vibration condition or the dewatering time condition. For example, the user may set a higher priority on the vibration condition or the dewatering time condition. In some cases, the priority may be determined at the time of the product release. In some implementations, the vibration condition may be taken into consideration, so the allowable UB value may be immediately decreased when the vibration value exceeds the allowable vibration value even once. In the case of the dewatering time, the average of the dewatering time, measured multiple times, exceeds the threshold time, the allowable UB value may be increased.

In some examples as illustrated in FIG. 6, when the dewatering time is equal to or lower than the threshold time and the vibration value is equal to or lower than the allowable vibration value (that is, when both the dewatering time condition and the vibration condition are simultaneously satisfied), the allowable UB value may be maintained. In other words, the controller 60 may not change the allowable UB value (that is, it may not evolve the UB table) when the dewatering time is equal to or lower than the threshold time and the vibration value is equal to or lower than the allowable vibration value.

As described above, the controller 60 may detect the laundry amount and laundry-tangled degree, and may change the allowable UB value associated with the detected laundry amount and laundry-tangled degree based on the dewatering time and vibration value measured during the dewatering process.

Specifically, as shown in FIG. 8, a preset UB table that includes an allowable UB value (a1, b1, . . . , d1, a2, . . . , d2, a3, . . . , d3) for each dewatering section (or each RPM section) according to each laundry amount and laundry-tangled degree may be stored in the controller 60 (or memory 78) of the washing machine.

The controller 60 may determine at least one allowable UB value, which is a criterion for stopping the rotation of the washing tub (or initialization (interruption) of the dewatering process) based on the laundry amount and laundry-tangled degree measured during the washing process (that is, measured before the dewatering process).

For example, when the detected laundry amount is a third level (level 3), and the detected laundry-tangled degree is a second step (class 2), the controller 60 may determine whether to stop the rotation of the washing tub (or initialization (interruption) of the dewatering process) during the dewatering process using the allowable UB value (a2, b2, c2, . . . , d2) related to the third level of the laundry amount and the second step (class) of the laundry-tangled degree.

For example, the UB value of a first section (section in which the washing tub rotates at 108 RPM), measured while laundry having the third level of laundry amount and the second step (class) of laundry-tangled degree is dewatered, exceeds the allowable UB value of a2 related to the first section, the controller 60 may control the motor to stop the rotation of the washing tub (initializing (interrupting) the dewatering process).

Hereinafter, description will be given under assumption that the detected laundry amount is the third level (level 3) and the detected laundry-tangled degree is the second step (class 2).

In addition, the controller 60 may measure a dewatering time and vibration value generated in the dewatering process each time when the dewatering process is performed, and the measured dewatering time and vibration value, as illustrated in FIG. 9, may be stored (recorded) by classifying (linking) them according to the detected laundry amount and laundry-tangled degree.

In other words, the controller 60 may create a table that includes a vibration value and a dewatering time according to each laundry amount and laundry-tangled degree.

The controller 60 may change the preset UB table based on the measured vibration value and dewatering time (that is, a table (history information) of vibration value and dewatering time according to each laundry amount and laundry-tangled degree). In detail, when the vibration value and the dewatering time are measured by the predetermined numbers or more (e.g., one vibration value, and three dewatering times) in a specific level of the laundry amount and a specific step of the laundry-tangled degree (e.g., a third level (level 3) of the laundry amount, a second step (class 2) of the laundry-tangled degree), the controller 60 may change the allowable UB value associated with the specific laundry amount and laundry-tangled degree in the preset UB table. As described above, the vibration value may be the maximum vibration displacement value measured in the dewatering process or the maximum vibration displacement value measured in a specific section (for example, a resonance section (150 to 600 RPM)).

As illustrated in (a) of FIG. 10, when a vibration value measured (pre-measured) in the specific laundry amount and laundry-tangled degree exceeds the allowable vibration value, the controller 60 may reduce the allowable UB value (a2, b2, c2, . . . , d2) related to the specific laundry amount and laundry-tangled degree.

In this case, as the allowable UB value is decreased, the number of cases for stopping rotation of the washing tub (the number of cases of initialization (interruption) of the dewatering process) is increased, and the laundry balancing (diffusion) process is performed frequently (laundry gets evenly loaded or untangled accordingly). As a result, unbalance (UB) is reduced and vibration noise is reduced accordingly.

As shown in (b) of FIG. 10, when the average of dewatering time measured (previously measured) multiple times in the specific laundry amount and laundry-tangled degree exceeds the threshold time, the controller 60 may increase the allowable UB value (a2, b2, c2, . . . , d2) associated with the specific laundry amount and laundry-tangled degree to reduce the dewatering time.

For example, the controller 60 may increase or decrease the allowable UB value at regular intervals within an allowable range. The allowable range may be, for example, a range between allowable UB values associated with tangled degrees (e.g., a first class of tangled degree and a third class of laundry-tangled degree) adjacent to the corresponding laundry amount and tangled degree (a third level of laundry amount and a second class of laundry-tangled degree) (for example, the allowable range of a2 may be a1<a2<a3).

Thereafter, the controller 60 may use the changed (adjusted) UB value to determine whether to stop rotation of the washing tub (whether to initialize (interrupt) the dewatering process) by comparing a UB value measured during the dewatering process with the changed (adjusted) allowable UB value.

Also, the controller 60 may newly measure a dewatering time and a vibration value of the relevant dewatering process after the changed allowable UB value applied dewatering process is finished, and may link (save, update) the newly measured dewatering time and vibration value with the corresponding laundry amount and tangled degree.

As described above, the present disclosure may reduce the allowable UB value when the vibration value previously measured in a specific laundry amount and laundry-tangled degree exceeds the allowable vibration value, and when the previously measured dewatering time (the average of a plurality numbers of dewatering time) exceeds the threshold time. Such processes may be performed continuously (or repeatedly or whenever a condition is satisfied).

Accordingly, the controller 60 may increase, decrease, or maintain the allowable UB value each time when a condition is satisfied. Such a change in the allowable UB value may be continuously performed based on the dewatering time and vibration value measured while a washing machine is in use.

In some examples, the controller 60 may set a range of variation (a value of variation) of the allowable UB value differently depending on whether there is a history of the allowable UB value change.

For example, when the average of dewatering time exceeds the threshold time, the controller 60 may increase the allowable UB value by a first value (for example, +50) to perform dewatering based on the increased allowable UB value. At this time, when a measured vibration value exceeds the allowable vibration value, the controller 60 may decrease the allowable UB value by a second value (for example, −40), smaller than the first value.

When the average of dewatering time exceeds the threshold time due to the decreased allowable UB value, the controller 60 may increase the allowable UB value by a third value (+30), smaller than the first and second values.

In other words, when changing the allowable UB value, the controller 60 may determine a value of variation (a range of variation, a size of variation) of the allowable UB value based on whether to increase or decrease the allowable UB value, and whether the allowable UB value has been increased or decreased. As described above, in case the allowable UB value needs to be increased but the allowable UB value has been recently decreased, the allowable UB value may be increased by a value of variation (+30) smaller than the decreased value of variation (−40).

When continuously increasing or decreasing the allowable UB value, the controller 60 may continuously change the allowable UB value to the same value of variation (+50, +50, +50 or −50, −50, −50).

In addition, the controller 60 may increase the allowable UB value in a different way based on whether the vibration value has exceeded the allowable vibration value, and the allowable UB value has decreased in the previous dewatering process.

For example, if there is no history (record) of vibration value being exceeded the allowable vibration value in the previous dewatering process, the controller 60 may increase the allowable UB value by the first value (for example, +50) when dewatering time exceeds the threshold time.

As another example, when there is a history (record) of vibration value being exceeded the allowable vibration value in the previous dewatering process, and thus the allowable UB value is decreased by the first value (−50), the controller 60 may increase the allowable UB value by the second value (+40) smaller than the first value so that the allowable UB value having the history of exceeding the allowable vibration value is not set or used as an allowable UB value again.

Through this configuration, the present disclosure can provide a new washing machine capable of changing (evolving) a preset UB table so as to simultaneously satisfy a vibration condition and a dewatering time condition while setting the vibration condition to have a higher priority, and a method for controlling the same.

In some examples, the controller 60 may decrease the allowable UB value based on when the vibration value exceeds the allowable vibration value.

In some examples, when the dewatering time exceeds the preset dewatering time (for example, 300 seconds) due to the decreased allowable UB value, the controller 60 may use the allowable UB value applied to the highest degree (class) of tangled laundry to perform the dewatering process.

In some implementations, the UB table may a plurality of allowable UB values (a1, a2, a3, . . . , b1, b2, b3, . . . , c1, c2, c3, . . . ). Each allowable UB value may correspond to one of a plurality of laundry-tangled degrees and one of a plurality of laundry amount levels. For instance, a1 corresponds to laundry-tangled degree class 1 and laundry amount level 3, and a2 corresponds to laundry-tangled degree class 2 and laundry amount level 3.

In some examples, the controller 60 may be configured to: determine whether the dewatering time exceeds a preset dewatering time limit based on decreasing the allowable UB value. The controller 60 may be configured to, based on the dewatering time exceeding the preset dewatering time, identify an allowable UB value (e.g., a3) in the UB table corresponding to a highest laundry-tangled degree (e.g., class 3) among the plurality of laundry-tangled degrees. The controller 60 may perform the dewatering stroke by using the allowable UB value (e.g., a3) corresponding to the highest laundry-tangled degree (e.g., class 3).

In some examples, as shown in FIG. 8, when the previously measured vibration value exceeds the allowable vibration value in a state the detected laundry amount is a third level (level 3) and tangled degree is a second step (class 2), the controller 60 may reduce the allowable UB value (for example, a2) associated with the corresponding laundry amount and tangled degree.

As the allowable UB value decreases, the number of cases for a UB value measured in the dewatering process exceeding the decreased allowable UB value is increased. Thus, the dewatering process is frequently initialized, resulting in the extended dewatering time.

In case the decreased allowable UB value applied dewatering process is performed, the controller 60 may perform the dewatering process by using the allowable UB value (for example, (a3, b3, c3, . . . , d3) applied to the highest laundry-tangled degree (class 3) when the dewatering time (for example, main dewatering entry time) exceeds a preset dewatering time limit (e.g., 300 seconds) due to the decreased allowable UB value.

For example, the allowable UB value may be associated with a larger allowable UB value as the laundry-tangled degree is higher (that is, laundry is severely tangled). In the present disclosure, when the dewatering time exceeds the dewatering time limit, an UB value related to another degree of tangled laundry may be used to complete the respective dewatering process so as to prevent the dewatering time from being infinitely extended even if the allowable UB value is decreased for reducing vibration.

However, the present disclosure is not limited to this, the controller 60 may also perform (or complete) the dewatering process by increasing the allowable UB value itself (a2, b2, c2, . . . , d2), which is related to the corresponding laundry amount and laundry-tangled degree or by using the allowable UB value applied to the highest laundry-tangled degree instead of using the UB table of FIG. 8 only when the dewatering time exceeds the preset dewatering time due to the decreased allowable UB value.

The controller 60 may change the allowable UB value associated with the preset UB table at a time when sensing the laundry amount and laundry-tangled degree are completed (for example, when rinsing is finished). That is, the point of time for evolving the UB table may be after completing detection of the laundry amount and laundry-tangled degree, and after detecting the laundry amount and laundry-tangled degree.

The controller 60 may not change the preset UB table until before the dewatering time and vibration value are measured (recorded, stored) by the predetermined number or more (e.g., three dewatering times and one vibration value) for each laundry amount and laundry-tangled degree.

The controller 60 may measure the dewatering time and vibration value n times according to the laundry amount and the laundry-tangled degree, and may save the measured dewatering time and vibration value in line with the laundry amount and laundry-tangled degree detected at the time of the measurement.

Thereafter, in a new washing operation, when the laundry amount and the laundry-tangled degree are detected, and the predetermined number of dewatering time and vibration values exist, the controller 60 may determine whether to change the allowable UB value included in the preset UB table based on the detected dewatering time and vibration value related to the prestored laundry amount and laundry-tangled degree.

In other words, the controller 60 may change the allowable UB value associated with the sensed laundry amount and laundry-tangled degree in the preset UB table based on the data of dewatering time and vibration value pre-measured in the sensed laundry amount and laundry-tangled degree.

The method of changing may be the same or similar to the aforementioned method.

In some implementations, when a vibration sensor is not provided in a washing machine, a UB value and an allowable UB value may be used instead of a vibration value and an allowable vibration value. For example, in case the vibration sensor capable of measuring the vibration value is not provided in a state the laundry amount and laundry-tangled degree are detected, the controller 60 may set the UB value (for example, an RPM fluctuation value of the washing tub), and the measured UB value may be stored linked with the detected laundry amount and laundry-tangled degree.

Here, the UB value may be, for example, an RPM fluctuation value or a current fluctuation value. The UB value may be the maximum UB value measured during the entire dewatering process or the maximum UB value measured in a resonance section (150 to 600 RPM).

Thereafter, when the same laundry amount and laundry-tangled degree are detected, the controller 60 may determine whether the pre-measured (stored) UB value exceeds the preset allowable UB value. When exceeded, the controller 60 may decrease the allowable UB value related to the corresponding laundry amount and laundry-tangled degree.

In other words, in case the vibration sensor is not provided, the above-described vibration value and allowable vibration value may be used as substitute for a UB value and an allowable UB value (or preset allowable UB value) so as to be applied in the same or similar manner.

In some examples, a washing machine may include an output unit 72. The output unit 72 may include at least one of a display unit and an audio output unit.

When the laundry amount and laundry-tangled degree are detected, and the allowable UB value is changed based on the existing data of dewatering time and vibration value associated with the detected laundry amount and laundry-tangled degree, the controller 60 may output information (notification information) notifying that the allowable UB value has changed through the output unit.

For example, when the allowable UB value has been changed, the controller 60 directly notifies the information of the changed allowable UB value such as "Allowable UB value has been changed" or "Washing performance has been improved", or outputs information notifying that evolving has been made due to the changed UB allowable value.

As another example, the controller 60 may output information notifying that a dewatering time or vibration noise is reduced due to the changed allowable UB value through the output unit 72.

For instance, when the allowable UB value is decreased, the controller 60 may output information notifying that vibration noise has been reduced (or setting has been changed so as to reduce vibration noise) through the output unit.

In addition, when the allowable UB value is increased, the controller 60 may output information notifying that the dewatering time is decreased (or setting has been changed so as to reduce a dewatering time) through the output unit.

Through this configuration, the present disclosure can not only change (evolve) the UB table in which the allowable UB value is associated with the laundry amount and laundry-tangled degree so as to satisfy both the dewatering time condition and vibration condition, but also provide an optimized user interface capable of notifying the relevant effects to the user.

In description of the specification, the controller 60 initializes (interrupts) the dewatering stroke (process) when the measured UB value exceeds the preset allowable UB value, but the present disclosure is not limited thereto.

The controller 60 may control the washing tub 4 to rotate (decrease) the washing tub 4 at rotational speed (for example, 80 RPM or lower) at which laundry may fall without being attached (stuck) to the washing tub so as to untangle the laundry.

In some implementations, description of the controller 60 initializing (interrupting) the dewatering stroke (process) may be understood that the controller 60 rotates (decelerates) the washing tub 4 at rotational speed (for example, 80 RPM or less) at which laundry can fall without being attached to the washing tub according to product design or user settings.

The aforementioned description may be equally applied to a method for washing machine control. The method for washing machine control, for example, may be performed by the controller 60.

According to an implementation of the present disclosure, one or more of the following effects can be provided.

First, the present disclosure can reduce noise generated by vibration in a high-speed dewatering process or reduce a dewatering time by changing a UB table, which is a criterion for initialization (interruption) of the dewatering stroke.

Second, the present disclosure can provide an optimized dewatering control method for dewatering while satisfying both a vibration condition and a dewatering time condition by changing a UB table.

Third, the present disclosure can provide an artificial intelligent dewatering control method capable of changing a UB table so as to address a condition or an issue that dissatisfies the user more when both a vibration condition and a dewatering time condition are not satisfied.

The effects of the present disclosure are not limited to those effects mentioned above, and other effects not mentioned may be clearly understood by those skilled in the art from the description of the appended claims.

The present disclosure can be implemented as computer-readable codes in a program-recorded medium. The computer-readable medium may include all types of recording devices each storing data readable by a computer system. Examples of such computer-readable media may include hard disk drive (HDD), solid state disk (SSD), silicon disk drive (SDD), ROM, RAM, CD-ROM, magnetic tape, floppy disk, optical data storage element and the like. The computer may include the processor or the controller. Therefore, it should also be understood that the above-described implementations are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

What is claimed is:

1. A washing machine, comprising:

a water storage tank;

a vibration sensor provided to the water storage tank;

a washing tub rotatably disposed in the water storage tank and configured to accommodate laundry therein;

a motor configured to rotate the washing tub; and a controller configured to:

measure an unbalance (UB) value based on rotating the washing tub during a dewatering stroke, control the motor to stop rotating the washing tub based on the UB value exceeding an allowable UB value included in a preset UB table, measure a dewatering time of the laundry and a vibration value during the dewatering stroke using the vibration sensor, and change the allowable UB value included in the preset UB table based on the dewatering time and the vibration value.

2. The washing machine of claim 1, wherein the controller is configured to:

compare the changed allowable UB value to the UB value measured during the dewatering stroke; and determine whether to stop rotating the washing tub based on comparing the changed allowable UB value to the UB value measured during the dewatering stroke.

3. The washing machine of claim 1, wherein the controller is configured to set a different allowable UB value based on a change of one or both of the dewatering time and the vibration value.

4. The washing machine of claim 3, wherein the controller is configured to:

increase the allowable UB value based on the dewatering time exceeding a threshold time; and decrease the allowable UB value based on the vibration value exceeding a reference vibration value.

5. The washing machine of claim 3, wherein the controller is configured to increase the allowable UB value based on an average of multiple dewatering times exceeding a threshold time.

6. The washing machine of claim 5, wherein the controller is configured to determine the average of the multiple dewatering times based on a predetermined number of latest dewatering times.

7. The washing machine of claim 4, wherein the controller is configured to decrease the allowable UB value based on one or more events of the measured vibration value exceeding the reference vibration value.

8. The washing machine of claim 4, wherein the controller is configured to decrease the allowable UB value based on (i) the dewatering time exceeding the threshold time and (ii) the vibration value exceeding the reference vibration value.

9. The washing machine of claim 4, wherein the controller is configured to maintain the allowable UB value based on (i) the dewatering time being less than or equal to the threshold time and (ii) the vibration value being less than or equal to the reference vibration value.

10. The washing machine of claim 1, wherein the controller is configured to:

determine a laundry amount and a laundry-tangled degree of the laundry accommodated in the washing tub;

identify an allowable UB value associated with the laundry amount and the laundry-tangled degree in the preset UB table; and change the allowable UB value associated with the laundry amount and the laundry-tangled degree in the preset UB table based on the dewatering time and the vibration value.

11. The washing machine of claim 7, wherein the preset UB table comprises a plurality of allowable UB values, each allowable UB value corresponding to one of a plurality of laundry-tangled degrees and one of a plurality of laundry amount levels, and wherein the controller is configured to:

determine whether the dewatering time exceeds a preset dewatering time limit based on decreasing the allowable UB value;

based on the dewatering time exceeding the preset dewatering time, identify an allowable UB value in the preset UB table corresponding to a highest laundry-tangled degree among the plurality of laundry-tangled degrees; and perform the dewatering stroke by using the allowable UB value corresponding to the highest laundry-tangled degree.

12. The washing machine of claim 1, wherein the controller is configured to output information indicating that the allowable UB value has been changed.

13. The washing machine of claim 1, wherein the controller is configured to output information indicating that the dewatering time or the vibration value has been reduced by the changed allowable UB value.

* * * * *